252-99 AU 157 EX
10/29/85 XR 4,549,979

United States Patent [19]
Chandra et al.

[11] Patent Number: 4,549,979
[45] Date of Patent: Oct. 29, 1985

[54] DETERGENT COMPOSITION WITH SILICONATE-SILICATE COPOLYMER

[75] Inventors: Grish Chandra; Jeffrey A. Kosal, both of Midland; Lenin J. Petroff, Bay City; Edwin P. Plueddemann, Midland, all of Mich.

[73] Assignee: Dow Corning Corporation, Midland, Mich.

[21] Appl. No.: 593,750

[22] Filed: Mar. 27, 1984

[51] Int. Cl.[4] ..... C11D 7/14
[52] U.S. Cl. ..... 252/135; 252/99; 252/109; 252/174.15
[58] Field of Search ..... 252/99, 109, 133, 135, 252/140, 174, 179, 174.15

[56] References Cited

U.S. PATENT DOCUMENTS

| | | | |
|---|---|---|---|
| 3,198,820 | 8/1965 | Pines et al. | 260/448.2 |
| 4,005,028 | 1/1977 | Heckert et al. | 252/99 |
| 4,138,363 | 2/1979 | Hertzenberg et al. | 252/430 |
| 4,157,978 | 6/1979 | Llenado | 252/135 |
| 4,216,125 | 8/1980 | Campbell et al. | 252/527 |
| 4,243,545 | 1/1981 | Campbell et al. | 252/140 |
| 4,333,843 | 6/1982 | Wing et al. | 252/75 |
| 4,344,860 | 8/1982 | Plueddemann | 252/389 |
| 4,352,742 | 10/1982 | Davis et al. | 252/75 |
| 4,354,002 | 10/1982 | Davis et al. | 524/588 |
| 4,362,644 | 12/1983 | Davis et al. | 252/389 |
| 4,370,255 | 1/1983 | Plueddemann | 252/389 |

FOREIGN PATENT DOCUMENTS 294890 4/1971 U.S.S.R. .

*Primary Examiner*—A. Lionel Clingman
*Assistant Examiner*—Hoa Van Le
*Attorney, Agent, or Firm*—James E. Bittell

[57] ABSTRACT

New granular detergent compositions suitable for heavy duty laundry and automatic dishwashing applications are disclosed. The detergents contain organic surfactant combined with a siliconate-silicate product that provides the compositions with improved dissolution characteristics in water. The siliconate-silicate component contains silicate units and anionic functional organosiliconate units represented by the formula $(MO-)_aO_{(3-a)/2}Si—R—Y_b$ wherein Y represents the anionic functional group, R is an organic linking group, b is an integer from 1 to 3, a has a value of from 0.5 to 2, and M is hydrogen or alkali metal.

19 Claims, No Drawings

DETERGENT COMPOSITION WITH SILICONATE-SILICATE COPOLYMER

BACKGROUND OF THE INVENTION

This invention relates to the field of alkali silicates and their use in detergent formulations. More particularly, it relates to the modification of the solubility characteristics of alkali silicates to make the alkali silicates more useful in detergent formulations.

Alkali silicates have been widely used in laundry detergents for many years. In addition to providing alkalinity and buffering, alkali silicates are important as corrosion inhibitors and process aids that improve the bead strength of detergent powders. Recent developments such as the reduction in the amount of phosphates in detergents; increased use of surfactants with unique properties; and the higher cost of energy, which affects household washing temperatures as well as the cost of manufacturing detergents by spray drying have compelled many changes in detergent formulations.

However, because of the nature of detergents as complex mixtures of ingredients, changing one component or process method can generate several new problems. In particular, the use of zeolites in detergents to replace all or part of the phosphates in formulations also containing alkali silicates has produced agglomerates that deposit on the fabric being laundered and are especially noticeable as white particulate material on dark fabrics. It has been suggested that the zeolite agglomeration results from the interaction of the zeolite with other detergent ingredients during the spray drying process.

Alkali silicates have been implicated as a component of detergents that may interact with zeolites to bind particles together and form nondispersible agglomerates. Consequently, it has been proposed that only limited amounts of silicate, 3% or less, should be used in zeolite built laundry detergents. Moreover, larger amounts of alkali silicates have been reported to decrease the ion exchange capacity and the rate of ion exchange of the zeolites in a formulated detergent. However, reducing the amount or eliminating alkali silicates in detergent formulations is not a satisfactory solution because it results in the loss or reduction of the valuable properties such as bead formation and anticorrosion that the silicate provides.

U.S. Pat. Nos. 4,138,363, 4,216,125 and 4,243,545 teach that the tendency of zeolites to agglomerate during detergent processing can be reduced by treating the zeolite surface with a hydrophilic functional silane. While acrylates, epoxies, amines and carboxylates are suggested as useful hydrophilic groups, the only silanes taught for treating the zeolite were beta-3,4-epoxycyclohexyl-ethyltrimethoxysilane, gamma-glycidoxypropyltrimethoxysilane and gamma-aminopropyltrimethoxysilane. However, the improvement achieved with these silane-zeolite composites has not been sufficient to result in commercial utilization.

Consequently there is still a need for a commercially viable way of making alkali silicates and zeolites compatible in detergent formulations. Accordingly, it is a purpose of the present invention to provide a method of modifying the solubility characteristics of alkali silicate so that alkali silicate solids and binder films present in detergent powders are more rapidly and readily resolubilized in water. Similarly, it is a purpose of this invention to provide detergent compositions containing a solubility-modified silicate ingredient. It is also an object of the invention to provide detergent compositions that are more rapidly and homogeneously soluble in water. Such detergent powders could be packaged, stored and shipped more economically and still be easy to use because of their rapid solubilization in water.

U.S. Pat. No. 4,157,978 teaches that multimeric silicates can be "capped" by aluminum diacetate groups and incorporated in spray dried detergent compositions to provide an overall improvement in the physical characteristics and rate of solubility of the resulting detergent granules. The patent also suggests that other "capped" silicate materials known in the art can be used in detergent formulations. As an example of such other "capped" silicates, the patent describes silicates "capped" by triorganosilyl groups.

Mixtures of alkali silicates and certain organofunctional siliconates have been prepared in aqueous solutions and have been found useful as corrosion inhibitors in antifreeze compositions for automotive cooling systems. The mixtures are generally considered to form copolymers in which the organofunctional siliconate units act to stabilize the silicate units in aqueous solutions. Specifically, the copolymer remains in solution under conditions of pH and concentration that result in the separation of gels or precipitates when alkali silicates are employed alone.

Siliconates with several types of organofunctional substituents have been found especially useful for stabilizing alkali silicates by formation of copolymers. For example, U.S. Pat. No. 3,198,820 teaches the use of siliconates with alkali carboxylate functional organic substituents; U.S. Pat. Nos. 4,352,742, 4,354,002, and 4,362,644 teach the use of siliconates with alkali sulfonate functional organic substituents; U.S. Pat. Nos. 4,370,255 and 4,333,843 teach the use of siliconates with alkali phosphonate functional organic substituents; U.S. Pat. No. 4,344,860 teaches the use of siliconates with sulfur or nitrogen containing alkali carboxylate functional organic substitutents; and U.S. Pat. No. 4,503,242 teaches the use of siliconates with amine containing alkali sulfonate functional organic substituents.

The siliconate-silicate references are all concerned with keeping alkali silicates in solution, especially in alcoholic antifreeze solutions.

SUMMARY OF THE INVENTION

The present invention provides improved detergent compositions comprising (A) 5 to 50 parts by weight of an organic surfactant selected from the group consisting of anionic, nonionic, and ampholytic surfactants and (B) 1 to 50 parts by weight of a siliconate-silicate product comprising 50 to 100 parts by weight of silicate units represented generally by the formula $(MO)_nSiO_{(4-n)/2}$ wherein M is hydrogen or alkali metal and n has an average value from 0.5 to 3 and 0.1 to 100 parts by weight of siliconate units represented generally by the formula $(MO)_aO_{(3-a)/2}Si—R—Y_b$ wherein Y represents an anionic functional group, R is an organic linking group wherein Y is positioned at least 2 and preferably at least 3 carbon atoms removed from the silicon atom, b is an integer from 1 to 3, a has a value of from 0.5 to 2, and M is hydrogen or alkali metal.

DETAILED DESCRIPTION OF THE INVENTION

The present invention is based on the discovery that siliconate-silicate solid products, deposited from equilibrated aqueous solutions of alkali metal silicate and anionic functional siliconates, dissolve more rapidly and completely than silicate solids deposited from unmodified solutions. The siliconate-silicate product is used in the detergent compositions of the present invention to provide granular detergents that are more rapidly and homogeneously dissolvable in water. Such detergent compositions have less tendency to cake or form lumps and consequently are more economical to package, store and ship. The detergent compositions of this invention also have reduced tendency to form insoluble agglomerates when particulates such as zeolite are included in the detergent formulation.

The siliconate-silicate products function much like silicate in detergent formulations in that they provide alkalinity and buffering, reduce corrosion, and act as process aids to improve the bead strength of detergent granules. But, in addition, the siliconate-silicate products provide added benefits resulting from their improved dissolution characteristics.

The siliconate-silicate product can be formed with any of the water soluble alkali metal silicates. Water soluble alkali metal silicates are well-known materials that are typically characterized as having a molar ratio of $SiO_2$ to alkali metal oxide of 1.0 to 4.0. Soluble silicates are available commercially as free flowing powders or as aqueous solutions ranging up to about 50 percent solids. The sodium silicates are usually preferred for preparing the compositions of this invention, although potassium and lithium silicates can also be used.

The anionic siliconates used to prepare the siliconate-silicate products are organosilicon compounds in which the organic substituent is attached to silicon by a silicon-carbon bond. The organic substituent also carries an anionic functional group which is attached to the substituent at least 2 and preferably 3 or more carbon atoms removed from the bond to silicon. An anionic functional group is a group that exists predominately in a disassociated ionic state in aqueous solutions and thus provides the organic substituent attached to silicon with a negative charge. Anionic functional groups can be described generally as salts of oxyacids. Anionic functional groups include salts of sulfonic acids, salts of phosphonic acid, salts of monoesters of phosphonic acids, and salts of carboxylic acids. Generally the alkali metal salts of the acids are preferred although salts derived from other bases such as organic quaternary ammonium hydroxide compounds can also be employed.

It should be understood that the organic substituent of the siliconate may also contain other functionality such as ether, sulfide, hydroxy, amide, and amine. Anionic siliconates are known materials and are described further in U.S. Pat. Nos. 3,198,820, 3,816,184, 4,235,638, 4,344,860, 4,352,742, 4,354,002, 4,362,644 and 4,370,255 which are hereby incorporated by reference to further illustrate the anionic functional siliconates and to show methods for their preparation.

The general form of the anionic siliconates can be represented by the formula:

$$(MO)_aO_{(3-a)/2}Si—R—Y_b$$

wherein R is an organic linking group wherein the anionic functionality or any other functionality is positioned at least 2 and preferably at least 3 carbon atoms removed from the silicon atom, Y represents anionic functional groups, and b represents the number of anionic functional groups on the linking group and can vary from 1 to 3. In the formula, M represents the cation of a strong base such as alkali metal cations or organo quaternary ammonium cations or M represents a hydrogen such that the siliconate also contains silanol functionality. Generally, a can vary from about 1 to 3.

The organic linking group, R, may contain other atoms in addition to carbon and hydrogen such as, for example, oxygen, sulfur, and nitrogen. These atoms may be present as other functional groups such as, for example, ether, sulfide, hydroxy, amide or amine. Other functionality as represented by these exemplary atoms should be positioned at least 2 and preferably 3 or more carbon atoms removed from the site of silicon atom attachment in the linking group. Such positioning of functionality within the linking group provides substituents on silicon that are more stable and less readily cleaved. Generally it is preferred that the linking group contain from 2 to a maximum of about 16 carbon atoms. While linking groups with greater than 16 carbon atoms may be used in the invention, it is believed that the hydrophobic character produced by such linking groups reduces the effectiveness of the siliconates so that linking groups with greater than 16 carbon atoms are less preferred.

Linking groups represented by R include, among others, polyvalent hydrocarbon radicals such as dimethylene, trimethylene, hexadecamethylene, phenylene, tolylene, xenylene, naphthylene and substituted polyvalent hydrocarbon radicals such as $—(CH_2)_3OCH_2CH(OH)CH_2—$, $—(CH_2)_3SCH_2—$,

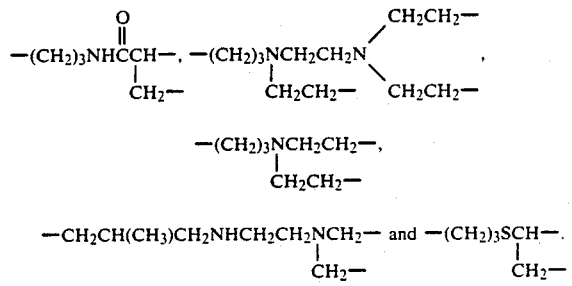

When M is an alkali metal cation it is preferred that it be sodium because of its ready availability and low cost. Similarly, the sodium salts of the oxyacids are preferred anionic functional groups in the siliconates.

For example, anionic siliconates suitable for the present invention include compositions conforming generally to the formulas:

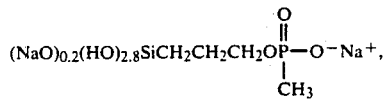

$$(NaO)_{0.1}(HO)_{1.9}O_{\frac{1}{2}}SiCH_2CH_2CH_2—P(=O)—(O^-Na^+)_2,$$

$$(NaO)_{0.2}(HO)_{2.8}Si(CH_2)_6SO_3^-Na^+,$$

$$(HO)_3SiCH_2CH_2CH_2OCH_2CH(OH)CH_2SO_3^-Na^+,$$

$$(HO)_2O_{\frac{1}{2}}SiCH_2CH_2—C_6H_5—SO_3^-K^+,$$

$$(KO)_{0.2}(HO)_{1.8}O_{\frac{1}{2}}SiCH_2CH_2SCH_2COO^-K^+.$$

-continued $$(NaO)_{0.1}(HO)_{1.9}O_1SiCH_2CH_2CH_2S\underset{\underset{CH_2COO^-Na^+}{|}}{C}HCOO^-Na^+,$$

$$(HO)_3SiCH_2\overset{\overset{CH_3}{|}}{C}HCH_2N(CH_2CH_2COO^-Na^+)_2,$$

$$(HO)_3SiCH_2CH_2CH_2NHCH_2CH_2N(CH_2COO^-Na^+)_2,$$

$$(NaO)_{0.2}(HO)_{2.8}SiCH_2CH_2CH_2\underset{\underset{CH_2CH_2COO^-Na^+}{|}}{N}CH_2CH_2N(CH_2CH_2COO^-Na^+)_2,$$

$$(NaO)_{0.1}(HO)_{2.9}SiCH_2CH_2CH_2NH\underset{\underset{CH_2COO^-Na^+}{|}}{C}\overset{\overset{O}{\|}}{C}HSO_3^-Na^+,$$

$$(NaO)_{0.2}(HO)_{2.8}SiCH_2CH_2CH_2\underset{\underset{CH_2SO_3^-Na^+}{|}}{N}CH_2CH_2N(CH_2SO_3^-Na^+)_2, \text{ and}$$

$$(NaO)_{0.2}(HO)_{1.8}O_1SiCH_2CH_2COO^-Na^+,$$

The anionic siliconates in which the organic substituent on silicon contains more than one anionic functional group are preferred because of their more highly anionic character and because of their improved effectiveness in modifying the dissolution characteristics of silicate solids. Specifically, anionic functional siliconates represented by the formula $$(MO)_aO_{(3-a)/2}Si—R—Y_b$$

wherein b has the value 2 or 3 are preferred. One especially preferred siliconate is represented generally by the formula $$(NaO)\ (HO)_2SiCH_2CH_2CH_2\underset{\underset{CH_2CH_2COO^-Na^+}{|}}{N}CH_2CH_2N(CH_2CH_2COO^-Na^+)_2$$

The anionic siliconates are water soluble materials and are usually prepared and stored in aqueous solutions. The water solubility and aqueous stability of the anionic functional siliconates facilitates preparation of the siliconate-silicate product. The siliconate-silicate product is prepared by mixing an aqueous solution of anionic functional siliconate with an aqueous solution of alkali metal silicate. Alternatively, powders of alkali metal silicate can be dissolved in an aqueous solution of anionic functional siliconate. In either case, the solution of the two components equilibrates within a short time to form a siliconate-silicate product. The equilibration is generally complete within one to two hours at room temperature. Of course, higher temperatures can be employed to accelerate the attainment of equilibrium but they are not necessary.

While the exact nature of the aqueous solution of the siliconate-silicate product is not known, applicants believe that the aqueous solutions of silicate and siliconate each contain equilibrium mixtures of dissolved monomer units and oligomeric species. During equilibration of the combined solutions, it is believed that the oligomers through a process of dissolution and reformation become mixtures or copolymers of the silicate and siliconate units. When the water is evaporated, the deposited oligomeric species are more readily redissolved because of the presence of siliconate units in the oligomeric species. In addition, the deposited oligomeric species are expected to retain improved dissolution properties during storage and exposure to atmospheric $CO_2$.

It should be understood that applicants do not intend to limit the invention by presenting this theory concerning the nature of siliconate-silicate products. Indeed, applicants recognize that other mechanisms may contribute to the benefits of the invention or may even completely account for the benefits.

The siliconate-silicate useful in this invention is generally described as a product comprising silicate units represented generally by the formula $$(MO)_nSiO_{(4-n)/2}$$

wherein M is hydrogen or alkali metal and n has an average value from 0.5 to 3 and siliconate units represented generally by the formula $$(MO)_aO_{(3-a)/2}Si—R—Y_b$$

wherein Y represents an anionic functional group, R is an organic linking group wherein Y is positioned at least 2 carbon atoms removed from the silicon atom, b is an integer from 1 to 3, a has a value of from 0.5 to 2, and M is hydrogen or an alkali metal.

The relative amounts of silicate and siliconate units that can be employed in the siliconate-silicate product can vary over a wide range. Generally, the more siliconate units employed the greater the effect on the dissolution properties of the siliconate-silicate product. However, it is usually preferred for economy to employ the minimum amount of siliconate units that will provide the desired improvement in dissolution. For the present invention, siliconate-silicate products containing 50 to 100 parts by weight of silicate units and 0.1 to 100 parts by weight of the siliconate units are generally useful. For economy, it is preferred to employ siliconate-silicate products consisting essentially of 50 to 100 parts by weight silicate units and 0.1 to 50 parts by weight siliconate units.

The detergent formulations of this invention contain from 1 to 50 parts by weight of siliconate-silicate product for each 5 to 50 parts by weight of surfactant. While detergent formulations may contain greater than 50 parts of the siliconate-silicate product, little additional benefit is derived from such high levels so that such formulations are economically undesirable.

The detergent compositions of this invention contain an organic detersive surfactant selected from the group consisting essentially of anionic, nonionic, and ampholytic surfactants. Any of the known water soluble detersive surfactants are anticipated to be useful in the detergent compositions of this invention. Water soluble detersive surfactants include the anionics such as common soap, alkylbenzene sulfonates and sulfates, paraffin sulfonates, and olefin sulfonates; the nonionics such as alkoxylated (especially ethoxylated) alcohols and alkyl phenols, amine oxides; and the ampholytics such as the aliphatic derivatives of heterocyclic secondary and tertiary amines.

In general, the detersive surfactants contain an alkyl group in the $C_{10}$–$C_{18}$ range; the anionics are most commonly used in the form of their sodium, potassium, or triethanolammonium salts; and the nonionics generally contain from about 3 to about 17 ethylene oxide groups.

U.S. Pat. No. 4,062,647 which is hereby incorporated by reference, contains detailed listings of the anionic, nonionic and ampholytic detersive surfactants useful in this invention. Mixtures, especially mixtures of $C_{12}$–$C_{16}$ alkyl benzene sulfonates with $C_{12}$–$C_{18}$ alcohol or alkylphenol ethoxylates (EO 3–15) provide detergent compositions with exceptionally good fabric cleaning properties.

The detergent compositions of this invention can also contain any of the well-known additional detergent ingredients. It is preferred, for example, that the detergent composition also contain 10 to 100 parts by weight of builder for each 5 to 50 parts by weight of surfactant. Typical builders include salts of phosphates, phosphonates, carbonates and polyhydroxysulfonates; as well as organic sequestering agents such as polyacrylates, polycarboxylates, polyaminocarboxylates and polyhydroxysulfonates; and ion exchange agents such as zeolites. Specific examples of preferred builders include sodium tripolyphosphates, zeolites, sodium carbonate, sodium citrate, polyacrylates and sodium nitrilotriacetates.

Detergent compositions of this invention containing zeolites are especially preferred because the siliconate-silicate product does not interact as much with zeolites to bind the particles together into nondispersible agglomerates. Nondispersible agglomerates are generally observed in detergent formulations containing zeolites combined with alkali silicates. Such agglomerates are a significant problem since they deposit on fabric being laundered and are especially noticeable as white specks on dark fabrics. The occurrence of such white specks is reduced significantly with the detergent compositions of this invention.

Any of the synthetic or natural zeolites can be employed in the detergent compositions. In general, synthetic zeolites are usually employed because they are more readily available and are specially manufactured to have more desirable and consistent properties. Synthetic crystalline sodium alumina silicates such as those described in U.S. Pat. Nos. 2,882,243, 3,012,853, 3,130,007, 3,329,628 and 4,303,629, among others, are suitable. While any zeolite can be used in detergents, it is usually preferred to employ zeolites conforming to the general formula:

$$Na_x[(AlO_2)_x(SiO_2)_y]zH_2O$$

where x and y are integers of at least 6; the ratio of x to y is in the range of 0.1 to 1.1; and z is an integer from about 8 to 270. In general, the water content of these zeolites is 15 to 35 percent by weight of the zeolite. Specific examples of useful zeolites include among others, zeolites generally conforming to the formula, $Na_{12}[(AlO_2)_{12}(SiO_2)_{12}]20\ H_2O$ and zeolites generally conforming to the formula $Na_x[(AlO_2)_x(SiO_2)_y]zH_2O$ where x is an integer between 80 and 96 and y is an integer between 112 and 96 and z is between 220 and 270. Zeolites are well known in the art and have been described in many patents in recent years for use as builders in laundry detergent formulations.

Other minor detergent ingredients as known in the art may be included for various purposes. For example, antiredeposition agents such as sodium carboxymethylcellulose, suds suppressors, enzymes, optical brighteners, perfumes, anticaking agents, dyes, colored specks, and fabric softeners can also be included in the detergent compositions. In addition, oxidizing agents such as chlorinated sodium orthophosphate, chlorinated isocyanurate, and perborate, possibly with a copper catalyst or an organic activator, can be included to form detergent compositions that are especially suitable as automatic dishwashing detergents.

Finally, bulking agents such as sodium sulfates, sodium chloride, and other neutral alkali metal salts can be added to the detergent formulation to facilitate measurement of appropriate amounts for individual wash loads.

The detergent compositions of this invention can be used as heavy-duty laundry detergents and as automatic dishwashing detergents. In both applications these detergents have increased utility because they dissolve more easily in water, especially at the lower washing temperatures that are increasingly used by today's energy-conscious consumers.

Any of the well-known commercial methods of preparing detergent compositions can be employed to make the detergent compositions of this invention. For example, the surfactant, siliconate-silicate product, and the desired builder can be combined in an aqueous slurry and then spray dried to provide granules. Another method involves wet mixing of the detergent components with a material that will absorb the water and result in a free flowing granular product. Alternatively, powdered or granular components for the detergent can be selected and then dry blended to provide the final composition.

The following examples are presented to illustrate the invention, but the examples in no way limit the scope of the invention as more fully set out in the claims. Unless otherwise indicated, concentrations of solutions are stated as mole percent which is the moles of solute in 100 g of solution.

EXAMPLE 1

This example shows the time required to solubilize deposited sodium silicate containing different amounts of combined anionic functional organosiliconate.

An aqueous solution of 0.1 mole percent sodium silicate ($SiO_2/Na_2O$ weight ratio of 3.22) was combined with various proportions by weight of an aqueous solution of 0.1 mole percent of the anionic functional organosiliconate represented by the average formula $$(NaO)_{0.3}(HO)_{2.7}Si(CH_2)_3\underset{\underset{CH_2CH_2COONa}{|}}{N}CH_2CH_2N(CH_2CH_2COONa)_2.$$

The combined solutions were allowed to equilibrate at room temperature for 16 hours. An equal portion of each solution (~4 drops) was placed between two microscope slides that were overlapped over a 1 inch portion of their lengths. The slides were placed in an oven at 100° C. for 30 minutes. Upon evaporation of water, a siliconate-silicate glass was deposited between the overlapping slides which acted as a cement to bind the slides together. The cemented slides were propped at a 45° angle in water at room temperature and the time required for the slides to separate under their own weight was determined. The time required for separation is representative of the relative rates of resolubilization of the deposited siliconate-silicate glasses. The results are presented in Table 1.

TABLE 1

RELATIVE RATE OF RESOLUBILIZATION OF SODIUM SILICATE WITH DIFFERENT AMOUNTS OF ANIONIC FUNCTIONAL OKANOSILICONATE

| Mole Ratio Siliconate/Silicate | Time Required for Slides to Separate |
|---|---|
| 1/5 | 0* |
| 1/10 | 50 minutes |
| 1/20 | 4 hours |
| 1/30 | 2 hours |
| 1/40 | 5 hours |
| 1/50 | 2 hours |
| Silicate Alone | 7 days |

*Separated while Placing in Water

EXAMPLE 2

This example shows that a difference in solubilization rate occurs even when the deposited silicate glasses are redissolved in water at elevated temperature.

Some of the equilibrated siliconate/silicate solutions of Example 1 were further tested by placing equal portions of the solution (3 drops) over a 1 inch portion of a fiberglass strand on the surface of a microscope slide. The slides were placed in an oven at 100° C. for 30 minutes. Upon evaporation of water, a siliconate-silicate glass was deposited which acted as a cement to bind the embedded fiberglass strand to the microscope slide. The microscope slides were then placed in a water bath at 54° C. with each slide supported in the water by its attached fiber. The times required for the slides to drop from the fibers were determined. This time is considered representative of the relative rates of resolubilization of the deposited siliconate-silicate glasses. The tests were performed with three separate trials for each solution to determine the reproducibility. The results are presented in Table 2.

TABLE 2

RATES OF RESOLUBILIZATION OF SILICONATE-SILICATE

| Mole Ratio Siliconate/Silicate | Trial 1 | Trial 2 | Trial 3 | Average |
|---|---|---|---|---|
| 1/5 | 6 min | 15 min | 11 min | 11 min |
| 1/50 | 5 min | 15 min | 35 min | 18 min |
| Silicate Alone | >3.5 hrs | 45 min | >3.5 hrs | >2.6 hrs |

EXAMPLE 3

This example illustrates the various anionic functional organosiliconates that are useful in the present invention.

Twenty parts by weight of an aqueous solution of 0.1 mole percent sodium silicate ($SiO_2/Na_2O$ weight ratio of 3.22) were combined with one part by weight of an aqueous solution of 0.1 mole percent of various anionic functional organosiliconates. The combined solutions were allowed to equilibrate at room temperature for 16 hours. An equal portion of each solution (~3 drops) was placed on a glass microscope slide and dried in an oven for 30 minutes at 100° C. A clear, hard, glassy spot of deposited siliconate-silicate was obtained on each microscope slide. Each microscope slide was then soaked in water at room temperature for 30 minutes. The extent of resolubilization of the siliconate-silicate spot was rated according to the following system: clear, glassy spot remaining with no apparent resolubilization—rating 5; middle of spot showing some resolubilization but heavy ring remaining—rating 4; partial resolubilization over entire spot, but heavy white residue remains—rating 3; general resolubilization with only a thin ring left at the edge of the spot—rating 2; and essentially complete resolubilization with no visible residue—rating 1. The ratings obtained with the various anionic functional organosiliconates are presented in Table 3. A comparison experiment was performed in which the compound, $$CH_3(CH_2)_7\underset{\underset{CH_2CH_2COONa}{|}}{N}CH_2CH_2N(CH_2CH_2COONa)_2$$

was employed instead of an anionic functional organosiliconate. The deposited sodium silicate spot in this comparison experiment showed no effect of resolubilization and received a 5 rating.

TABLE 3

RESOLUBILIZATION EFFECTS OF VARIOUS ANIONIC FUNCTIONAL ORGANOSILICONATES

| | Organic Substituent of the Siliconate | Rating |
|---|---|---|
| 1. | None (silicate alone) | 5 |
| 2. | $-CH_2CH_2COONa$ | 3 |
| 3. | $-CH_2CH_2SCH_2CH_2COONa$ | 5 |
| 4. | $-CH_2CH_2CH(CH_3)COONa$ | 4 |
| 5. | $-CH_2CH_2CH_2\overset{\overset{O}{\|\|}}{\underset{\underset{CH_3}{\|}}{P}}-ONa$ | 2 |
| 6. | $-(CH_2)_3OCH_2CH(OH)CH_2SO_3Na$ | 4 |
| 7. | $-(CH_2)_3\underset{\underset{CH_2CH_2COONa}{\|}}{N}CH_2CH_2N(CH_2CH_2COONa)_2$ | 1 |
| 8. | $-(CH_2)_3\underset{\underset{CH_2COONa}{\|}}{N}CH_2CH_2N(CH_2COONa)_2$ | 2 |
| 9. | $-(CH_2)_3NHCH_2CH_2NHCH_2\underset{\underset{CH_2COONa}{\|}}{C}HCOONa$ | 2 |

EXAMPLE 4

Two siliconate-silicate copolymers were prepared employing two siliconates with different types of anionic functional groups.

Copolymer I was prepared by mixing 2800 g of a 15 weight percent solids, aqueous solution of sodium silicate (2.4 weight ratio $SiO_2/Na_2O$) with 848.4 g of a 52.7 weight percent solids, aqueous solution of the siliconate generally conforming to the formula, $$(NaO)_{0.1}(HO)_{2.9}Si(CH_2)_3O-\overset{\overset{O}{\|\|}}{\underset{\underset{CH_3}{\|}}{P}}-O^-Na^+.$$

The mixture was allowed to age at room temperature for 3 days before further use in detergent formulations. Copolymer I contains about 2.3 silicate units per siliconate unit.

Copolymer II was prepared by mixing 2800 g of a 15 weight percent solids, aqueous solution of sodium silicate (2.4 weight ratio $SiO_2/Na_2O$) with 843.5 g of a 51.4 weight percent solids, aqueous solution of the siliconate generally conforming to the formula $$(NaO)_{0.3}(HO)_{2.7}Si(CH_2)_3\underset{\underset{CH_2CH_2COO^-Na^+}{|}}{N}CH_2CH_2N(CH_2CH_2COO^-Na^+)_2.$$

The mixture was allowed to age at room temperature for 3 days before further use in detergent formulations. Copolymer II contains about 5 silicate units per siliconate unit.

EXAMPLE 5

This example illustrates a preparation of granular detergent compositions containing siliconate-silicate copolymer with zeolite as the primary builder.

A granular detergent composition was prepared with each of the siliconate-silicate copolymers of Example 4 by first forming a slurry of the following composition:

| | |
|---|---|
| 800 g | Aqueous sodium salt of dodecylbenzenesulfonic acid (60 wt %) |
| 240 g | Sodium sulfate |
| 400 g | Sodium carbonate |
| 800 g | Detergent grade zeolite-A |
| 3475 g | Solution of siliconate-silicate copolymer from Example 4 |
| 600 g | Water |

The slurries were spray dried utilizing a laboratory scale rotary spray dryer. The conditions for drying were selected to provide about 6 to 8 percent residual water in the final granular product. The drying of these slurries was free from problems and the powders produced were free flowing. Detergent Compositions A, B, and C were prepared containing, respectively, untreated sodium silicate, Siliconate-Silicate Copolymer I, and Siliconate-Silicate Copolymer II all as described in Example 4. Detergent Composition A is outside the scope of this invention and is presented for comparison purposes only.

EXAMPLE 6

This example illustrates a preparation of granular detergent compositions containing siliconate-silicate copolymer with sodium tripolyphosphate as the primary builder.

Detergent compositions were prepared with the two siliconate-silicate copolymers of Example 4 by first forming a slurry of the following composition:

| | |
|---|---|
| 800 g | Aqueous sodium salt of dodecylbenzenesulfonic acid (60 wt %) |
| 240 g | Sodium sulfate |
| 1200 g | Sodium tripolyphosphate |
| 3475 g | Solution of siliconate-silicate copolymer from Example 4 |
| 600 g | Water |

The slurries were spray dried utilizing a laboratory scale rotary spray dryer. The powders obtained had residual water contents of about 10 percent by weight. Detergent compositions D, E, and F were prepared containing, respectively, untreated sodium silicate, Siliconate-Silicate Copolymer I, and Siliconate-Silicate Copolymer II. Detergent Composition D is outside the scope of this invention and is presented for comparison purposes only.

EXAMPLE 7

The detergent compositions prepared in Examples 5 and 6 were evaluated by a black cloth test to determine the amount of insoluble particles that might be retained on fabric while laundering. For the test, 0.75 g of the granular detergent composition was agitated for 10 minutes in 1000 ml of deionized water with an impellar blade stirrer operating at 350 rpm. After agitation, the mixture was vacuum filtered through a 13 mm diameter piece of black broadcloth. After the cloth had air dried, the extent of white particles was evaluated visually on a scale of 1 to 5 and the reflectivity of the cloth was measured. A higher reflectivity corresponds to retention of a higher amount of white particles on the black cloth. The results are shown in Table 4.

TABLE 4

BLACK CLOTH TEST FOR INSOLUBLE PARTICLES

| Detergent Composition | Visual Rating* | Reflectivity |
|---|---|---|
| A | 4.7 | 51 |
| B | 2.5 | 2.3 |
| C | 1.5 | 0 |
| D | 4.0 | 15.2 |
| E | 2.0 | 4.6 |
| F | 1.5 | 2.8 |

*Rating scale:
1 = completely black cloth,
2 = trace white specks,
3 = distinct white dots,
4 = significant coverage of cloth, and
5 = complete coverage of cloth.

EXAMPLE 8

This example compares the $Ca^{++}$ ion exchange capacity and rate of ion exchange for the detergent compositions containing siliconate-silicate copolymers versus detergent compositions containing unmodified sodium silicate.

A 0.2 g portion of each detergent composition from Example 5 was added to a 50 ml portion of a stock solution containing 272 ppm $Ca^{++}$ as calcium chloride. The detergent was mixed in the $Ca^{++}$ containing water for precisely 2 minutes and the mixture was quickly filtered to remove all undissolved portions of the detergent powder. The filtrate was then titrated with a standard solution of ethylenediaminetetraacetic acid to determine the amount of $Ca^{++}$ remaining in the filtrate. The results are presented in Table 5.

TABLE 5

CALCIUM ION EXCHANGE PROPERTIES OF ZEOLITE-CONTAINING DETERGENTS

| Detergent Composition | Amount of $Ca^{++}$ Left After Detergent Treatment (ppm) |
|---|---|
| A (control) | 78 |
| B | 61 |
| C | 98 |

That which is claimed is:

1. A detergent composition comprising (A) 5 to 50 parts by weight of an organic surfactant selected from the group consisting of anionic, nonionic and ampholytic surfactants, and (B) 1 to 50 parts by weight of a siliconate-silicate product comprising (a) 50 to 100 parts by weight of silicate units represented generally by the formula $(MO)_nSiO_{(4-n)/2}$ wherein M is hydrogen or alkali metal and n has an average value from 0.5 to 3 and (b) 0.1 to 100 parts by weight of siliconate units represented generally by the formula $(MO)_aO_{(3-a)/2}Si—R—Y_b$ wherein Y represents an anionic functional group, R is an organic linking group wherein Y is positioned at least 2 carbon atoms removed from the silicon atom, b is an integer from 1 to 3, a has a value of from 0.5 to 2, and M is hydrogen or alkali metal.

2. The detergent composition of claim 1 which further comprises 10 to 100 parts by weight of builder selected from the group consisting of tripolyphosphates, zeolites, carbonates, citrates, polyacrylates, and nitrilotriacetates.

3. The detergent composition of claim 2 wherein the anionic functional group is an alkali metal salt of an oxyacid selected from the group consisting of alkali metal salts of sulfonic acids, phosphonic acids, monoesters of phosphonic acids and carboxylic acids.

4. The detergent composition of claim 3 wherein the organic linking group, R, contains 2 to 16 carbon atoms and is selected from the group consisting of radicals composed of carbon and hydrogen; radicals composed of carbon, hydrogen, and oxygen; radicals composed of carbon, hydrogen, and sulfur; and radicals composed of carbon, hydrogen, and nitrogen.

5. The detergent composition of claim 4 wherein b is 2 or 3.

6. The detergent composition of claim 5 wherein Y is an alkali metal salt of carboxylic acid group.

7. The detergent composition of claim 6 wherein R is a radical composed of carbon, hydrogen and nitrogen atoms.

8. The detergent composition of claim 7 wherein the anionic functional siliconate unit is represented by the formula $$(MO)_aO_{(3-a)/2}SiCH_2CH_2CH_2\underset{\underset{CH_2CH_2COO^-Na^+}{|}}{N}CH_2CH_2N(CH_2CH_2COO\ Na)_2$$

wherein M is hydrogen or sodium.

9. The detergent composition of claim 4 wherein Y is the sodium salt of a monoester of phosphonic acid.

10. The detergent composition of claim 9 wherein the anionic functional siliconate unit is represented by the formula $$(MO)_aO_{(3-a)/2}SiCH_2CH_2CH_2\underset{\underset{CH_3}{|}}{\overset{\overset{O}{\|}}{P}}—O^-Na^+$$

wherein M is hydrogen or sodium.

11. A detergent composition comprising (A) 5 to 50 parts by weight of an organic surfactant selected from the group consisting of anionic, nonionic, and ampholytic surfactants, and (B) 1 to 50 parts by weight of a siliconate-silicate product comprising (a) 50 to 100 parts by weight of silicate units represented generally by the formula $(MO)_nSiO_{(4-n)/2}$ wherein M is hydrogen or alkali metal and n has an average value from 0.5 to 3;

(b) 0.1 to 100 parts by weight of siliconate units represented generally by the formula $(MO)_aO_{(3-a)/2}Si—R—Y_b$ wherein Y represents an anionic functional group, R is an organic linking group wherein Y is positioned at least 2 carbon atoms removed from the silicon atom, b is an integer from 1 to 3, a has a value of from 0.5 to 2, and M is hydrogen or alkali metal; and (c) 10 to 100 parts by weight of zeolite.

12. The detergent composition of claim 11 wherein the anionic functional group is an alkali metal salt of an oxyacid selected from the group consisting of alkali metal salts of sulfonic acids, phosphonic acids, monoesters of phosphonic acids, and carboxylic acids.

13. The detergent composition of claim 11 wherein the organic linking group, R, contains 2 to 16 carbon atoms and is selected from the group consisting of radicals composed of carbon and hydrogen; radicals composed of carbon, hydrogen, and oxygen; radicals composed of carbon, hydrogen, and sulfur; and radicals composed of carbon, hydrogen, and nitrogen.

14. The detergent composition of claim 13 wherein b is 2 or 3.

15. The detergent composition of claim 14 wherein Y is an alkali metal salt of a carboxylic acid group.

16. The detergent composition of claim 15 wherein R is a radical composed of carbon, hydrogen, and nitrogen atoms.

17. The detergent composition of claim 16 wherein the anionic functional siliconate unit is represented by the formula $$(MO)_aO_{(3-a)/2}SiCH_2CH_2CH_2\underset{\underset{CH_2CH_2COO^-Na^+}{|}}{N}CH_2CH_2N(CH_2CH_2COO^-Na^+)_2$$

wherein M is hydrogen or sodium.

18. The detergent composition of claim 13 wherein Y is the sodium salt of a monoester of phosphonic acid.

19. The detergent composition of claim 18 wherein the anionic functional siliconate unit is represented by the formula $$(MO)_aO_{(3-a)/2}SiCH_2CH_2CH_2\underset{\underset{CH_3}{|}}{\overset{\overset{O}{\|}}{P}}—O^-Na^+$$

wherein M is hydrogen or sodium.

* * * * *